US008125434B2

(12) United States Patent
Huitema et al.

(10) Patent No.: US 8,125,434 B2
(45) Date of Patent: Feb. 28, 2012

(54) METHOD FOR ADDRESSING ACTIVE MATRIX DISPLAYS WITH FERROELECTRICAL THIN FILM TRANSISTOR BASED PIXELS

(75) Inventors: Hjalmar Edzer Ayco Huitema, Veldhoven (NL); Gerwin Hermanus Gelinck, Valkenswaard (NL)

(73) Assignee: Creator Technology B.V., Breda (NL)

( * ) Notice: Subject to any disclaimer, the term of this patent is extended or adjusted under 35 U.S.C. 154(b) by 943 days.

(21) Appl. No.: 12/091,677

(22) PCT Filed: Nov. 3, 2007

(86) PCT No.: PCT/IB2006/054107

§ 371 (c)(1),
(2), (4) Date: May 30, 2008

(87) PCT Pub. No.: WO2007/057811

PCT Pub. Date: May 24, 2007

(65) Prior Publication Data

US 2008/0259066 A1 Oct. 23, 2008

Related U.S. Application Data

(60) Provisional application No. 60/737,167, filed on Nov. 16, 2005.

(51) Int. Cl.
*G09G 3/36* (2006.01)

(52) U.S. Cl. ..... 345/97; 345/92; 345/95; 345/208; 345/210; 345/204

(58) Field of Classification Search ..... 345/1.1–111, 345/204–215, 690–699; 315/169.3, 169.4
See application file for complete search history.

(56) References Cited

U.S. PATENT DOCUMENTS

| | | | | | |
|---|---|---|---|---|---|
| 4,112,333 | A * | 9/1978 | Asars et al. | ..... | 345/90 |
| 4,794,385 | A * | 12/1988 | Kuijk | ..... | 345/84 |
| 5,436,742 | A * | 7/1995 | Tanaka et al. | ..... | 349/25 |
| 5,663,744 | A * | 9/1997 | Seike et al. | ..... | 345/95 |
| 5,721,597 | A * | 2/1998 | Kakinuma et al. | ..... | 349/86 |
| 5,847,686 | A * | 12/1998 | Mouri et al. | ..... | 345/94 |
| 6,163,360 | A * | 12/2000 | Tanaka et al. | ..... | 349/172 |
| 7,639,211 | B2 * | 12/2009 | Miyazawa | ..... | 345/39 |
| 7,864,148 | B2 * | 1/2011 | Martinot-Lagarde et al. | .. | 345/92 |
| 8,044,882 | B1 * | 10/2011 | Fan | ..... | 345/38 |
| 2002/0149555 | A1 * | 10/2002 | Kimura | ..... | 345/97 |
| 2004/0145551 | A1 * | 7/2004 | Tobita | ..... | 345/87 |
| 2006/0152458 | A1 * | 7/2006 | Angele et al. | ..... | 345/90 |

OTHER PUBLICATIONS

International Search Report for PCT/IB2006/054107 Mar. 20, 2007.

* cited by examiner

*Primary Examiner* — Lun-Yi Lao
*Assistant Examiner* — Gene W Lee

(57) ABSTRACT

A pixel (P) of a display (20) includes a memory element in a form of a ferroelectric thin film transistor ("TFT") (60) and a display element (62) operably coupled to the ferroelectric TFT (60). The ferroelectric TFT (60) is set to a conductive state in response to a conductive row drive voltage and a conductive column drive voltage being applied to the ferroelectric TFT (60) during a beginning phase of the addressing period for the pixel (P). The ferroelectric TFT (60) facilitates a charging of the display element (62) in response a charging row drive voltage and a charging column drive voltage being applied to the ferroelectric TFT (60) during an intermediate phase of the addressing period for the pixel (P). The ferroelectric TFT (60) is reset to a non-conductive state in response to a non-conductive row drive voltage and a non-conductive column drive voltage being applied to the ferroelectric TFT (60) during an ending phase of the addressing period for the pixel (P).

20 Claims, 14 Drawing Sheets

METHOD FOR ADDRESSING ACTIVE MATRIX DISPLAYS WITH FERROELECTRICAL THIN FILM TRANSISTOR BASED PIXELS

FIELD OF INVENTION

The present invention generally relates to active matrix displays of any type (e.g., active matrix electrophoretic displays and active matrix liquid crystal displays). The present invention specifically relates to an addressing scheme for active matrix displays employing pixels with each pixel having a memory element in the form of ferroelectric thin film transistor.

BACKGROUND

FIG. 1 illustrates a ferroelectric thin film transistor 15 having a ferroelectric insulator layer 16 that can be organic or inorganic. Ferroelectric thin film transistor 15 further has a gate electrode G, a source electrode S, and a drain electrode D with the ferroelectric insulator layer 16 being between gate electrode G and a combination of source electrode S and drain electrode D.

In operation, ferroelectric thin film transistor 15 can be switched between a conductive state commonly known as a normally-on state and a non-conductive state commonly known as a normally-off state based on a differential voltage $V_{GS}$ between a gate voltage $V_G$ and a source voltage $V_S$ and a differential voltage $V_{DS}$ between drain voltage $V_D$ and the source voltage $V_S$ both having an amplitude that generates an electric field over ferroelectric insulator layer 16 that is higher than a coercive electric field associated with ferroelectric insulator layer 16. Specifically, differential voltages $V_{GS}$ and $V_{DS}$ both having an amplitude that is equal to or less than a negative switching threshold −ST generates an electric field over ferroelectric insulator layer 16 that switches ferroelectric thin film transistor 15 to a normally-on state. Conversely, differential voltages $V_{GS}$ and $V_{DS}$ both having an amplitude that is equal to or greater than a positive switching threshold +ST generates an electric field over ferroelectric insulator layer 16 that switches ferroelectric thin film transistor 15 to a normally-off state.

SUMMARY OF THE INVENTION

The present invention provides a new and unique addressing scheme for active matrix displays employing pixels having memories elements in the form of ferroelectric thin film transistors in view of selectively switching each ferroelectric thin film transistor between a conductive state and a non-conductive state during an addressing period for an corresponding pixel.

In one form of the present invention, a display comprises a row driver, a column driver and a pixel, which includes a memory element in the form of a ferroelectric thin film transistor operably coupled to the row driver and the column driver, and a display element operably coupled to the ferroelectric thin film transistor. The row driver and the column driver are operable to apply different sets of drive voltages to the ferroelectric thin film transistor during a beginning phase, an intermediate phase and an ending phase of an addressing period for the pixel. The ferroelectric thin film transistor is operable to be set to a conductive state in response to a conductive row drive voltage and a conductive column drive voltage being applied to the ferroelectric thin film transistor by the row driver and the column driver during the beginning phase of the addressing period for the pixel. The ferroelectric thin film transistor is further operable to facilitate a charging of the display element in response to a charging row drive voltage and a charging column drive voltage being applied to the ferroelectric thin film transistor by the row driver and the column driver during the intermediate phase of the addressing period for the pixel. The ferroelectric thin film transistor is further operable to be reset to a non-conductive state in response to a non-conductive row drive voltage and a non-conductive column drive voltage being applied to the ferroelectric thin film transistor by the row driver and the column driver during the ending phase of the addressing period for the pixel.

BRIEF DESCRIPTION OF THE DRAWINGS

The foregoing form and other forms of the present invention as well as various features and advantages of the present invention will become further apparent from the following detailed description of various embodiments of the present invention read in conjunction with the accompanying drawings. The detailed description and drawings are merely illustrative of the present invention rather than limiting, the scope of the present invention being defined by the appended claims and equivalents thereof.

DETAILED DESCRIPTION OF THE DRAWINGS

Figure 2:
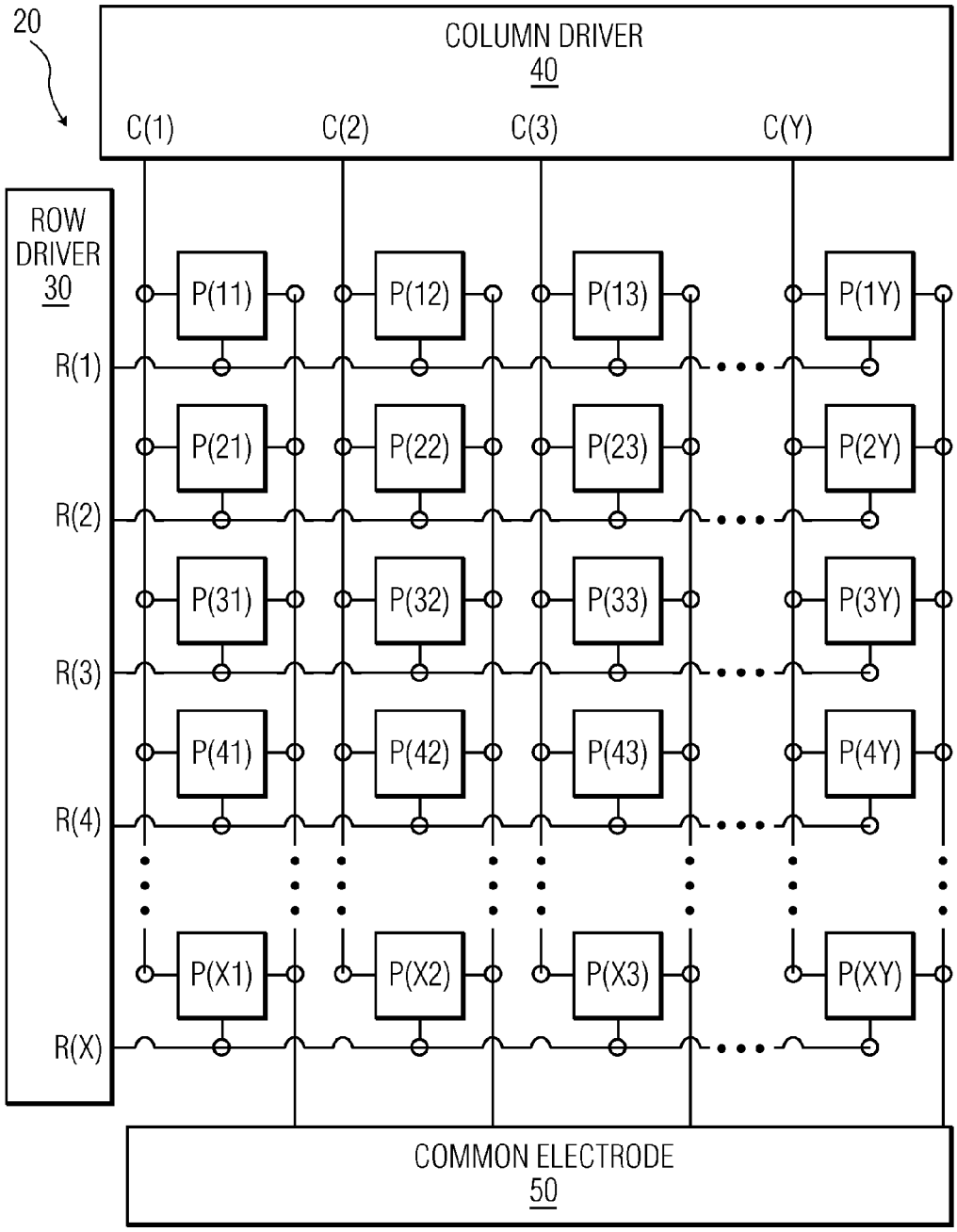
FIG. 2 illustrates one embodiment a block diagram of a display in accordance with the present invention.

A display 20 of the present invention as illustrated in FIG. 2 employs a column driver 30, a row driver 40, a common electrode 50 and an X×Y matrix of pixels P. Each pixel P employs a memory element in the form of a ferroelectric thin film transistor and a display element of any form (e.g., an electrophoretic display element and a liquid crystal display element). The present invention does not impose any limitations or any restrictions to the structural configurations of the memory element and the display element of each pixel P. Thus, the following description of an exemplary embodiment of a memory element and a display element of a pixel P does not limit nor restrict the scope of structural configurations of the memory element and the display element of each pixel P in accordance with the present invention.

Figure 1:
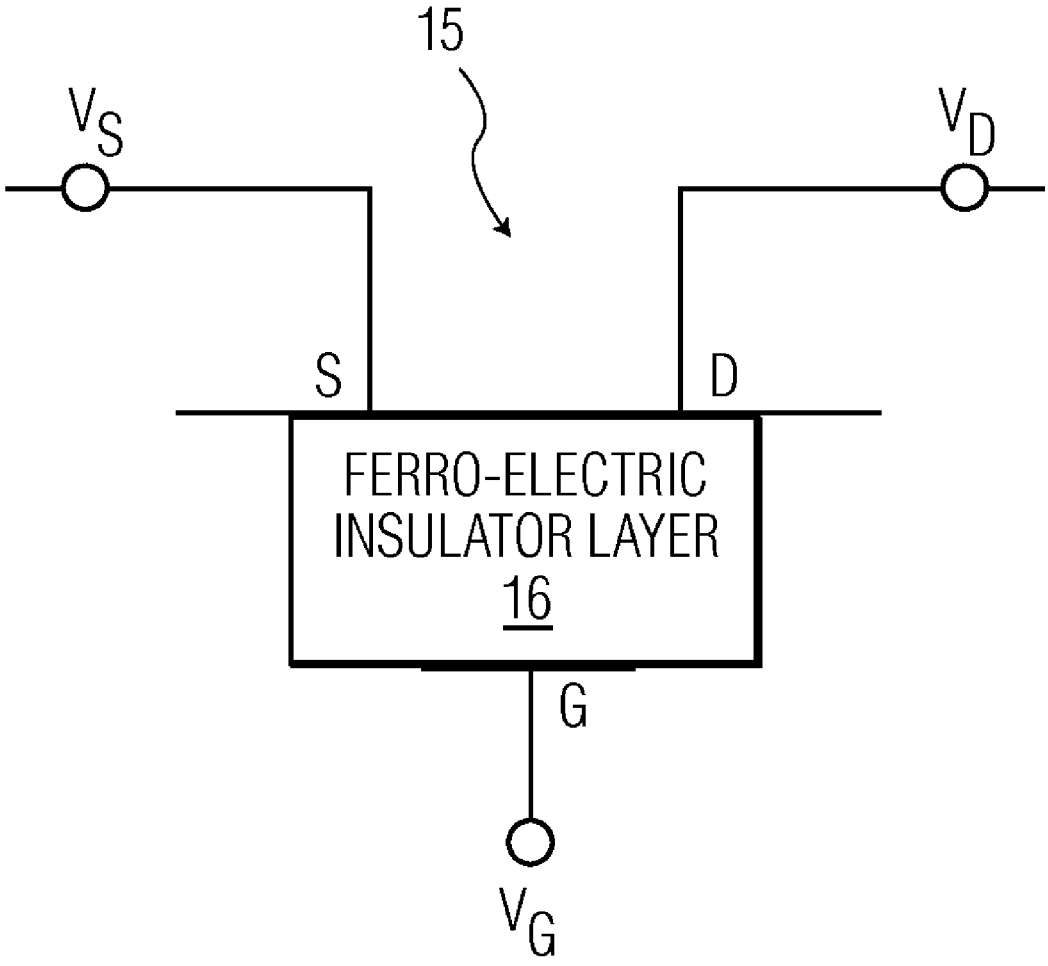
FIG. 1 PRIOR ART
FIG. 1 illustrates a schematic diagram of a ferroelectric transistor as known in the art.
Figure 3:
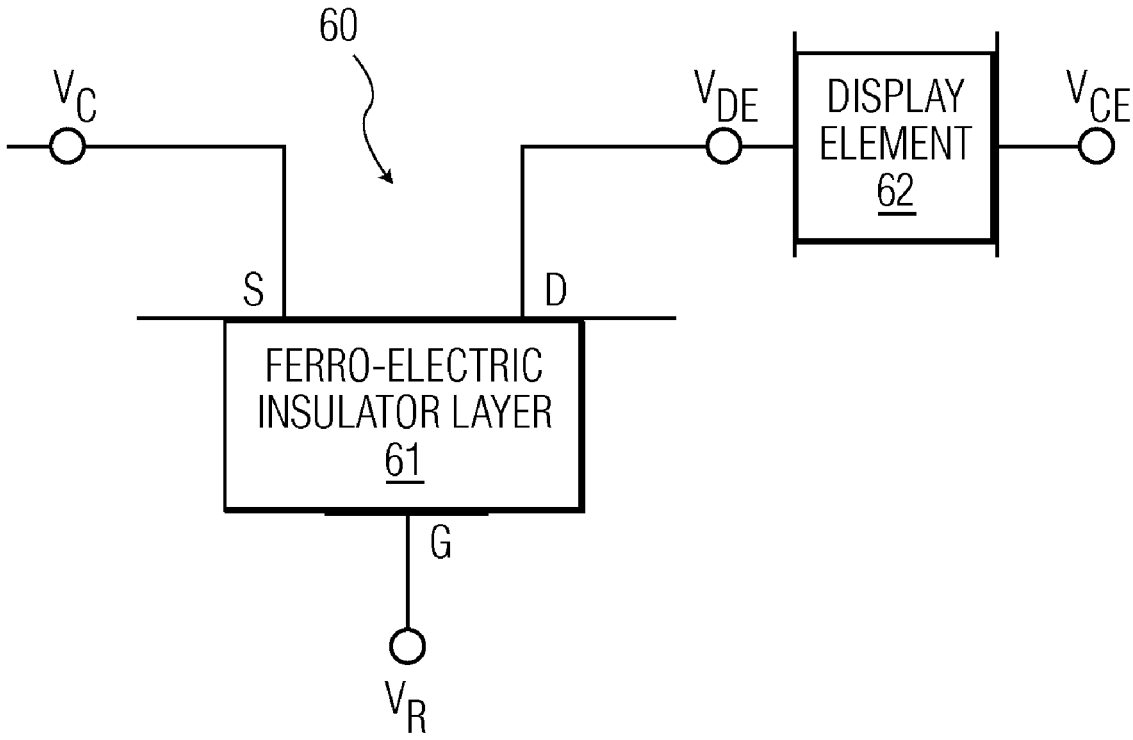
FIG. 3 illustrates one embodiment of a schematic diagram of a pixel in accordance with the present invention.

A memory element 60 in the form of a ferroelectric thin film transistor and a display element 62 of the present invention are illustrated in FIG. 3. Ferroelectric thin film transistor 60 has a ferroelectric insulator layer 61 that can be organic or inorganic. Ferroelectric thin film transistor 60 further has a gate electrode G operably coupled to row driver 30 (FIG. 1), a source electrode S operably coupled to column driver 40 (FIG. 1), and a drain electrode D operably coupled to display element 62, which is also operably coupled to common electrode 60 (FIG. 1). In an alternative embodiment, source electrode is operable coupled to display element 62 and drain electrode D is operably coupled to column driver 40.

In operation, a row drive voltage $V_R$ can be applied to gate electrode G of ferroelectric thin film transistor 60 by row driver 30 and a column drive voltage $V_C$ can be applied to a source electrode S of ferroelectric thin film transistor 60 by column driver 40 whereby display element 62 can be selectively charged in dependence of a differential between a drain electrode voltage $V_{DE}$ and a common electrode voltage $V_{CE}$. The present invention provides a new and unique active matrix addressing scheme representative by a flowchart 70 as illustrated in FIG. 4 for controlling various amplitudes of row drive voltage $V_R$ and column drive voltage $V_C$ during different phases of an addressing period of a pixel in view of achieving an optimal trade-off between a frame rate of display 20, a size of ferroelectric thi film transistor 60 and an amplitude ceiling of row drive voltage $V_R$ with an elimination of any kickback.

Figure 4:
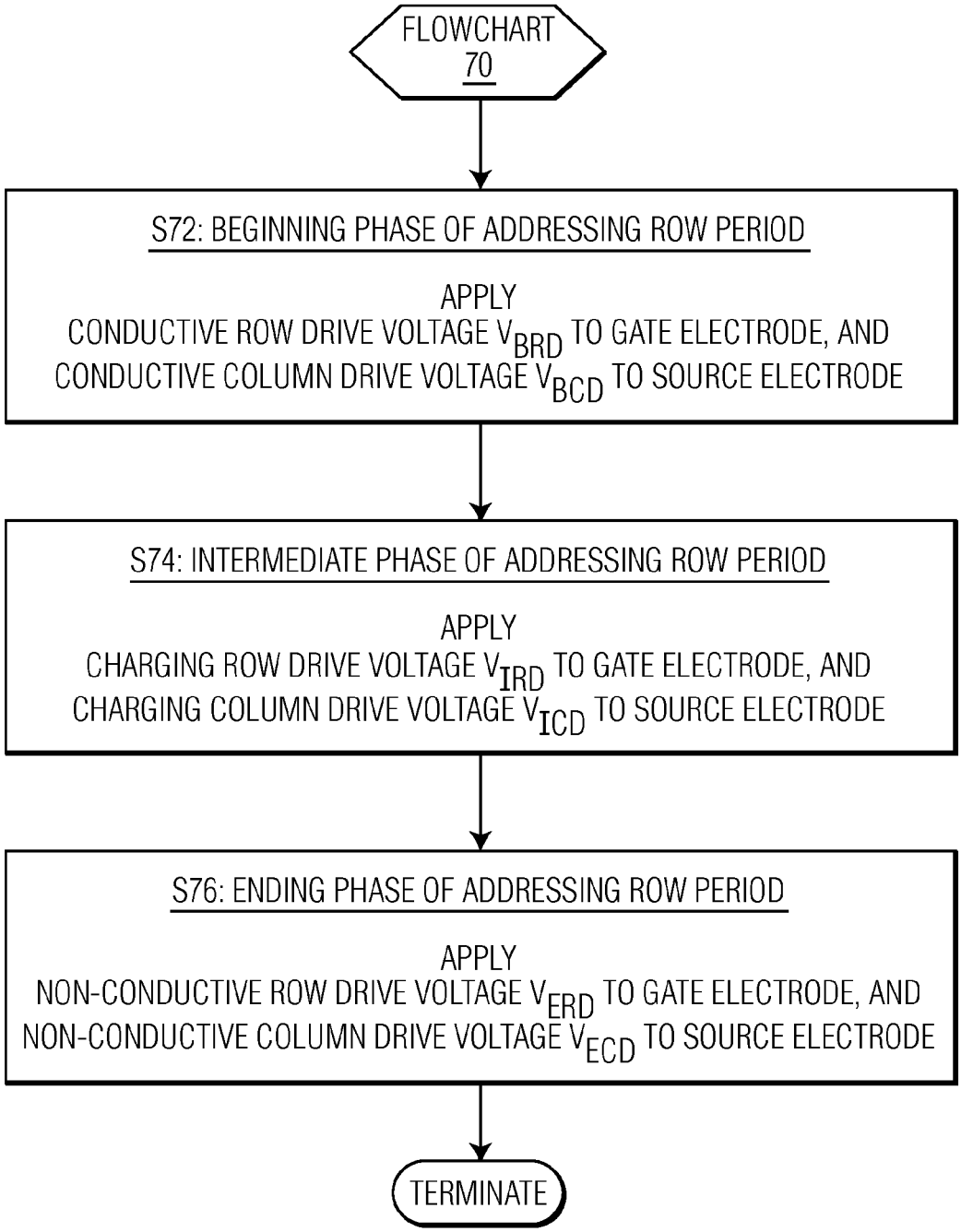
FIG. 4 illustrates a flowchart representative of one embodiment of an active matrix display addressing scheme of the present invention.

Referring to FIGS. 3 and 4, a stage S72 of flowchart 70 encompasses applying row drive voltage $V_R$ as a conductive row drive voltage $V_{BRD}$ to gate electrode G of ferroelectric thin film transistor 60 and applying column drive voltage $V_C$ as a conductive column drive voltage $V_{BCD}$ to source electrode S of ferroelectric thin film transistor 60 during a beginning phase of an addressing period for the pixel. In this beginning phase, differential voltage $V_{GS}$ between conductive row drive voltage $V_{BRD}$ and conductive column drive voltage $V_{BCD}$ is designed to be less than or equal to the negative switching threshold −ST whereby ferroelectric thin film transistor 60 is switched to a normally-on state (i.e., a conductive state).

A stage S74 of flowchart 70 encompasses applying row drive voltage $V_R$ as a charging row drive voltage $V_{IRD}$ to gate electrode G of ferroelectric thin film transistor 60 and applying column drive voltage $V_C$ as a charging column drive voltage $V_{ICD}$ to source electrode S of ferroelectric thin film transistor 60 during an intermediate phase of the addressing period for the pixel. In this intermediate phase, differential voltage $V_{GS}$ between charging row drive voltage $V_{IRD}$ and charging column drive voltage $V_{ICD}$ is designed to be less than the positive switching threshold +ST whereby ferroelectric thin film transistor 60 is maintained in the normally-on state.

A stage S76 of flowchart 70 encompasses applying row drive voltage $V_R$ as a non-conductive row drive voltage $V_{ERD}$ to gate electrode G of ferroelectric thin film transistor 60 and applying column drive voltage $V_C$ as a non-conductive column drive voltage $V_{ECD}$ to source electrode S of ferroelectric thin film transistor 60 during an ending phase of the addressing period for the pixel. In this ending phase, differential voltage $V_{GS}$ between non-conductive row drive voltage $V_{ERD}$ and non-conductive column drive voltage $V_{ECD}$ is designed to be equal to or greater than the positive switching threshold +ST whereby ferroelectric thin film transistor 60 is switched to a normally-off state (i.e., a non-conductive state) that results in the charging of the pixel during the intermediate phase being retained by the pixel.

Figure 5:
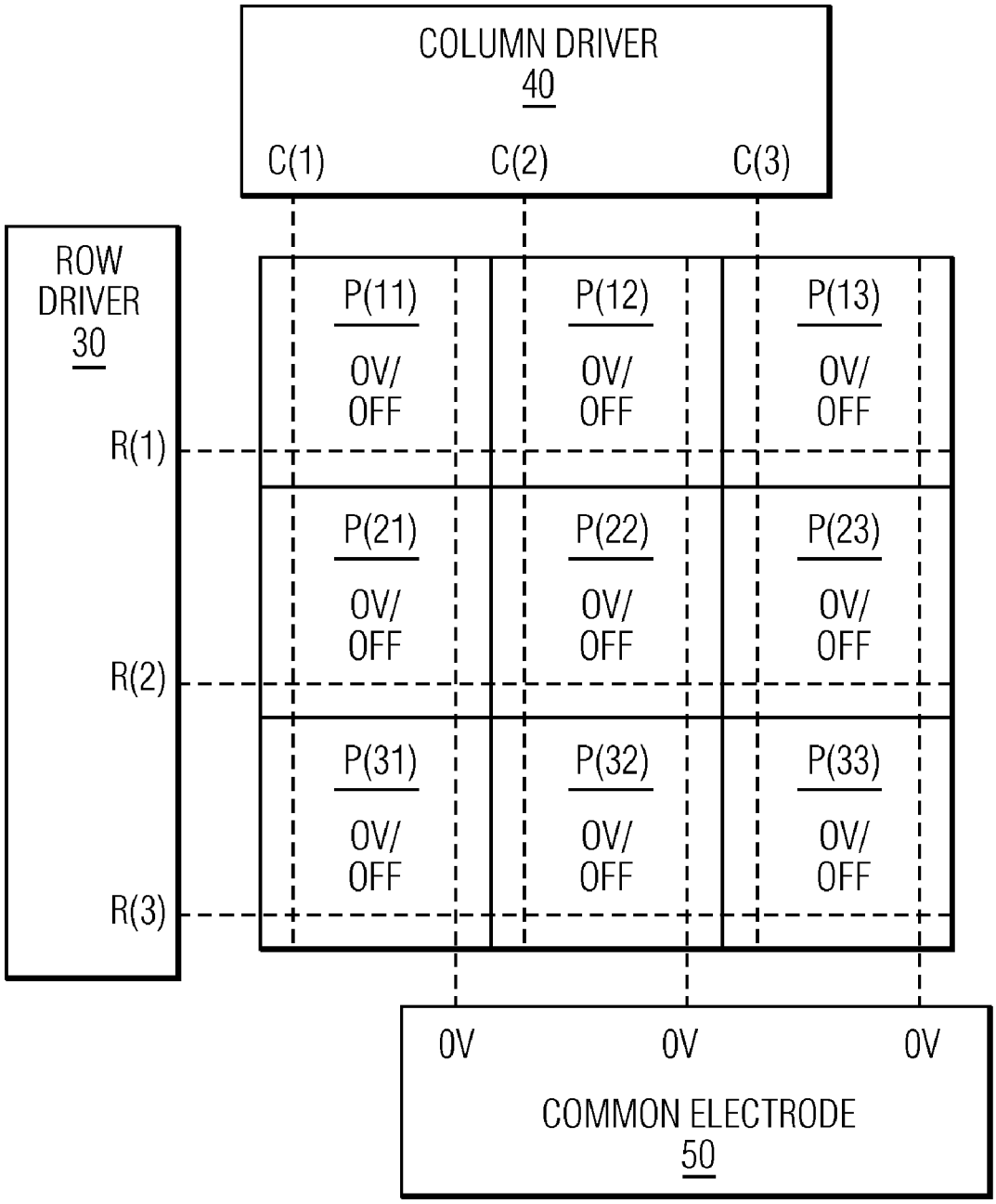
FIGS. 5-11 illustrate a flowchart representative of one embodiment of an active matrix electrophoretic display addressing scheme of the present invention.

To facilitate an understanding of the active matrix addressing scheme of the present invention as embodied in FIG. 70 (FIG. 4), the following is a description of an active matrix electrophoretic addressing scheme of the present invention as embodied in a flowchart 80 as illustrated in FIGS. 6-11. As illustrated in FIG. 5, flowchart 80 will be described in the context of (1) a 3×3 pixel matrix based on a switching threshold of 30 volts with a switching time of 1 microsecond, (2) a display element voltage $V_{DE}$ being −15 volts/0 volts/+15 volts for display element 62, (3) a common electrode voltage $V_{CE}$ of 0 volts and (4) the ferroelectric thin film transistors 60 of pixels P(11)-P(33) being initial set to a normally-off state whereby a charge of 0 volts is applied across display element 62.

Figure 6:
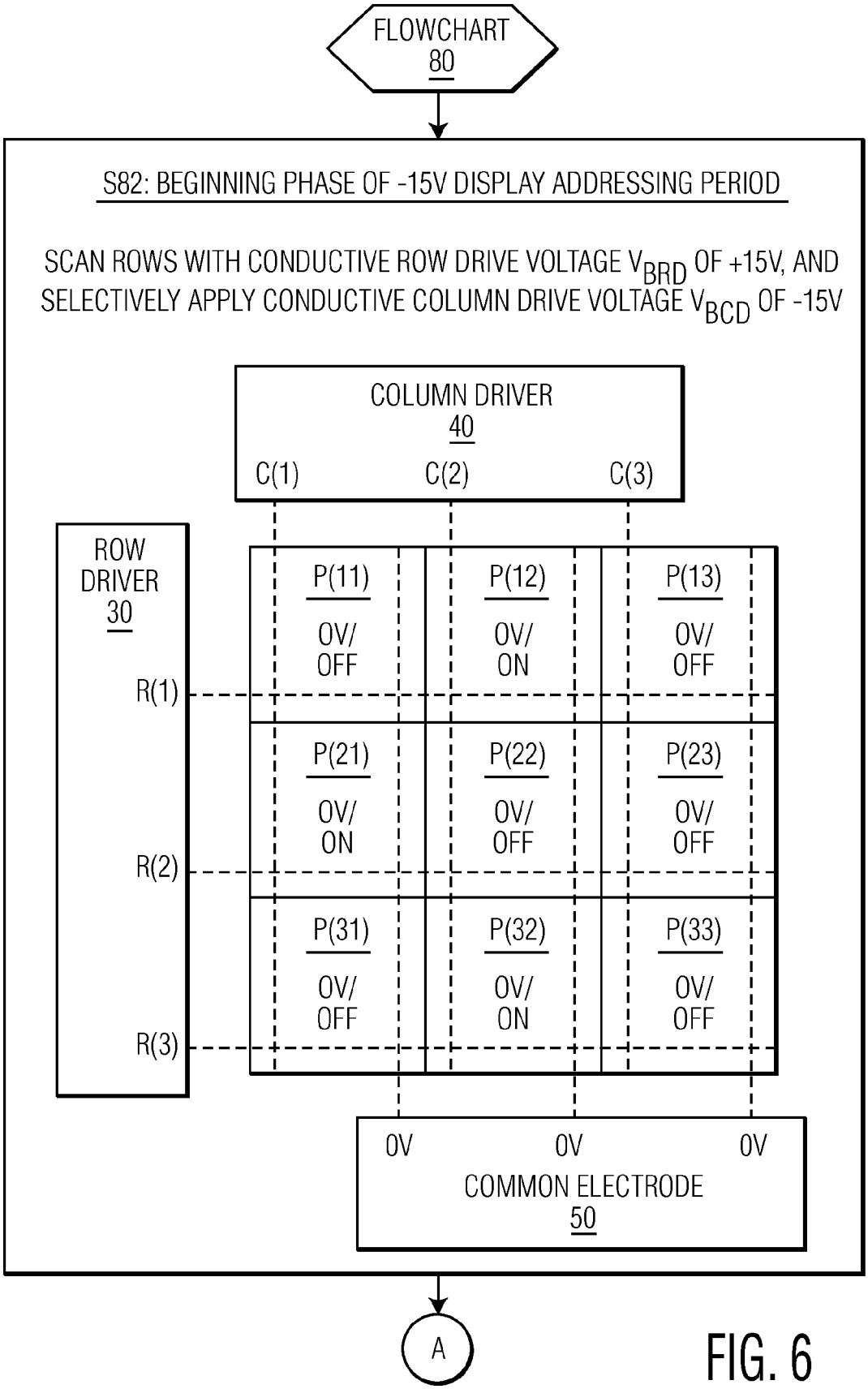

Referring to FIG. 6, a stage S82 of flowchart 80 encompasses a scanning of rows R(1)-R(3) with conductive row drive voltages $V_{BRD}$ in the form of a −15 pulse with each row scan facilitating a selective application of a conductive column drive voltage $V_{BCD}$ in the form of a +15 pulse to each pixel selected for display. The following TABLE 1 specifies an exemplary row scanning of the 3×3 pixel matrix illustrated in FIG. 6 with pixels P(12), P(21) and P(32) being selected for display during this −15V display addressing period:

TABLE 1

| | | | |
|---|---|---|---|
| 1st Row Scan | | | |
| R(1) = −15 volts | C(1) = 0 volts | C(2) = +15 volts | C(3) = 0 volts |
| 2nd Row Scan | | | |
| R(2) = −15 volts | C(1) = +15 volts | C(2) = 0 volts | C(3) = 0 volts |
| 3rd Row Scan | | | |
| R(3) = −15 volts | C(1) = 0 volts | C(2) = +15 volts | C(3) = 0 volts |

The result is the transistors of pixels P(12), P(21) and P(32) being switched to a normally-on state (i.e., conductive state) while the transistors of the remaining pixels are maintained in the initial normally-off state as illustrated in FIG. 6.

Figure 7:
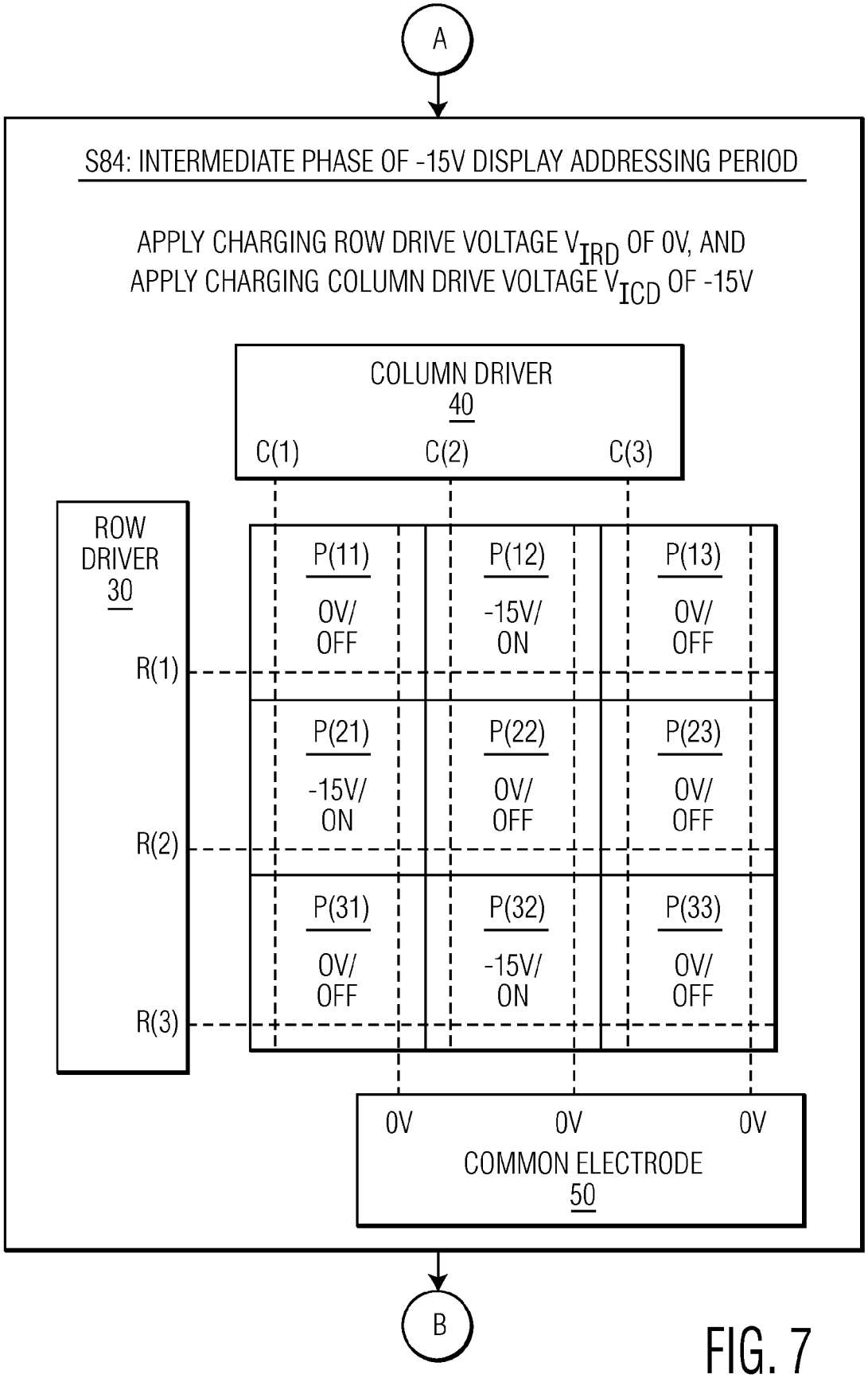

Referring to FIG. 7, a stage S84 of flowchart 80 encompasses applying charging row drive voltages $V_{IRD}$ of 0 volts on rows R(1)-R(3) and applying charging column drive voltages $V_{ICD}$ of −15 volts on columns C(1)-C(3) during an intermediate phase of the −15V display addressing period. The result is pixels P(12), P(21) and P(32) will be charged to −15 volts for display purposes while the transistors of the remaining pixels are maintained in the initial normally-off state as illustrated in FIG. 7.

Figure 8:
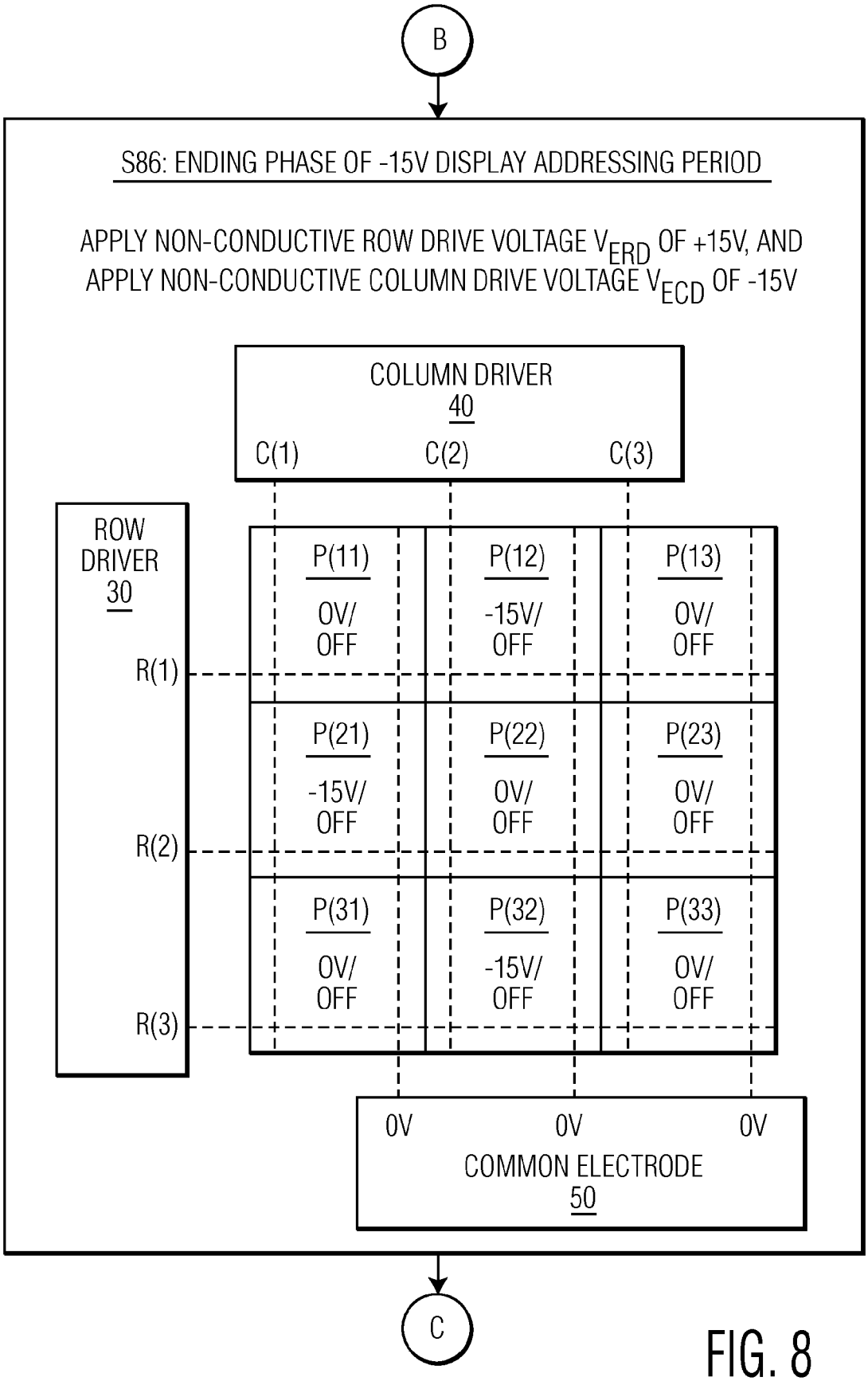

Referring to FIG. 8, a stage S86 of flowchart 80 encompasses applying non-conductive row drive voltages $V_{ERD}$ of +15 volts on rows R(1)-R(3) and applying non-conductive column drive voltages $V_{ECD}$ of −15 volts on columns C(1)-C(3) during an ending phase of the −15V display addressing period. The result is all of the transistors are set to the normally-off state with the previous charge of −15 volts of pixels P(12), P(21) and P(32) being retained for display purposes as illustrated in FIG. 8.

Figure 9:
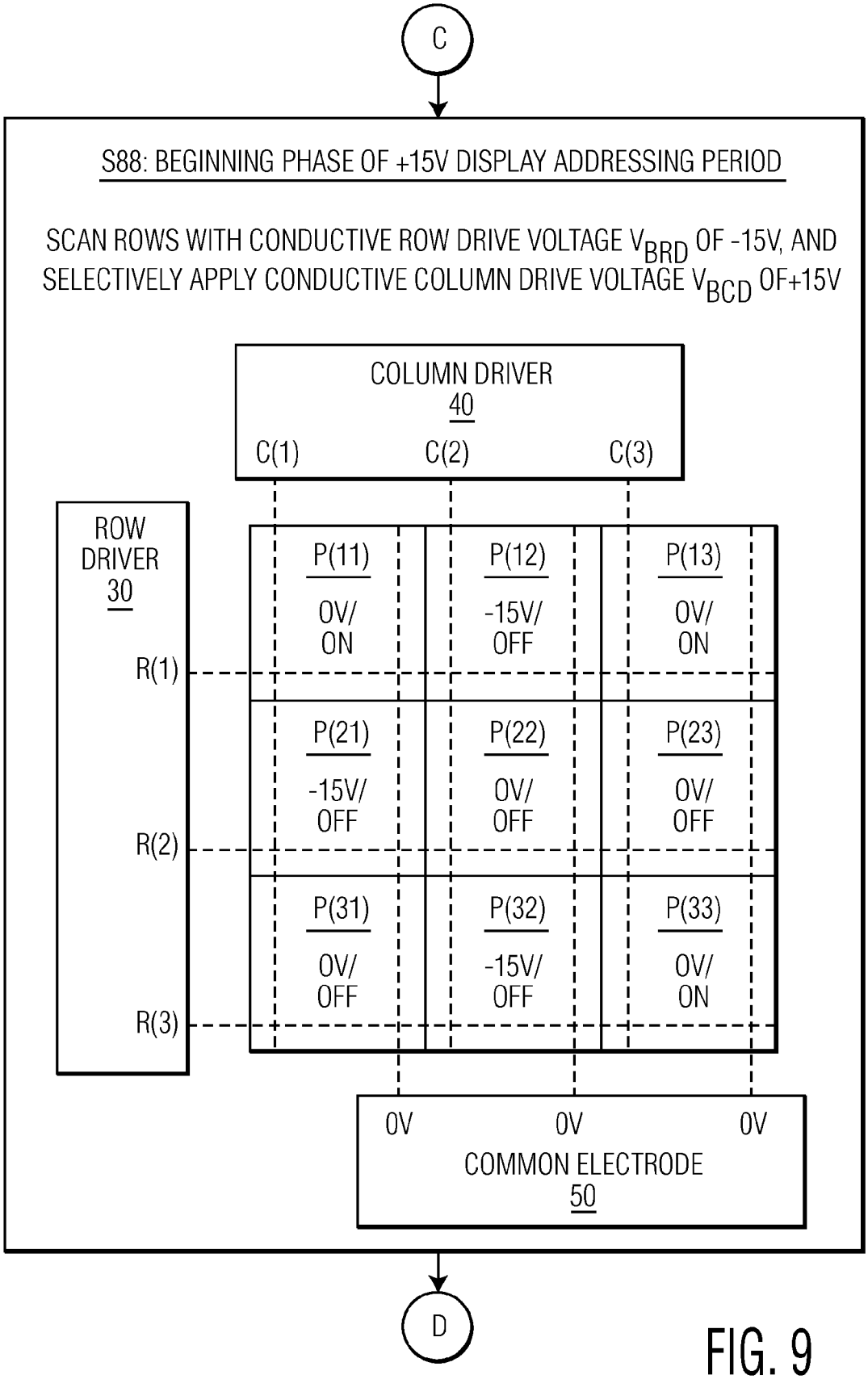

Referring to FIG. 9, a stage S88 of flowchart 80 encompasses a scanning of rows R(1)-R(3) with conductive row drive voltages $V_{BRD}$ in the form of a −15 pulse with each row scan facilitating a selective application of a conductive column drive voltage $V_{BCD}$ in the form of a +15 pulse to each pixel selected for display. The following TABLE 2 specifies an exemplary row scanning of the 3×3 pixel matrix illustrated in FIG. 9 with pixels P(11), P(13) and P(33) being selected for display during this +15V display addressing period:

TABLE 2

| | | | |
|---|---|---|---|
| 1st Row Scan | | | |
| R(1) = −15 volts | C(1) = +15 volts | C(2) = 0 volts | C(3) = +15 volts |
| 2nd Row Scan | | | |
| R(2) = −15 volts | C(1) = 0 volts | C(2) = 0 volts | C(3) = 0 volts |
| 3rd Row Scan | | | |
| R(3) = −15 volts | C(1) = 0 volts | C(2) = 0 volts | C(3) = +15 volts |

The result is transistors of pixels P(11), P(13) and P(33) being switched to a normally-on state (i.e., conductive state) while the transistors of the remaining pixels are maintained in the initial normally-off state as illustrated in FIG. 9.

Figure 10:
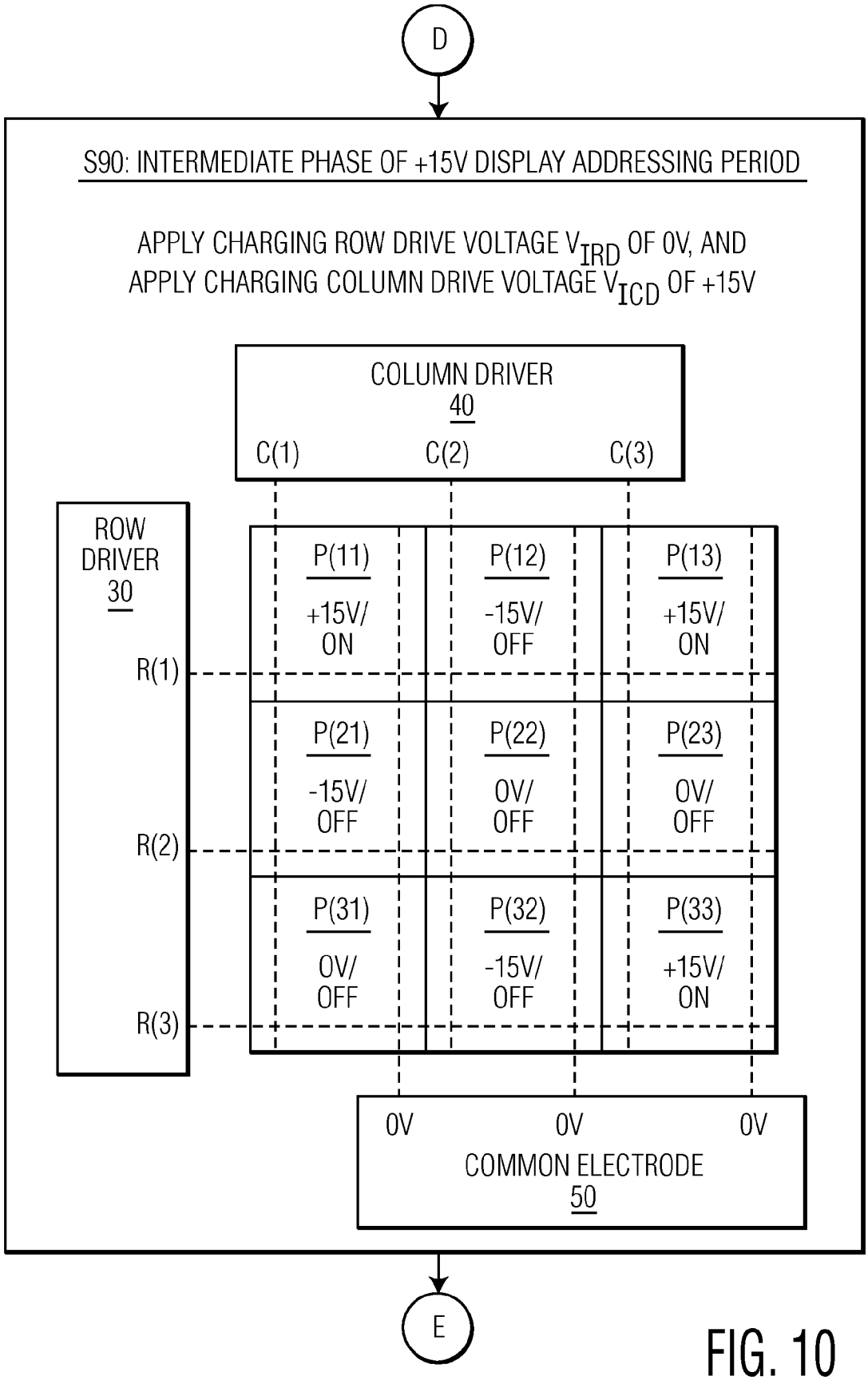

Referring to FIG. 10, a stage S90 of flowchart 80 encompasses applying charging row drive voltages $V_{IRD}$ of 0 volts on rows R(1)-R(3) and applying charging column drive voltages $V_{ICD}$ of +15 volts on columns C(1)-C(3) during an intermediate phase of the +15V display addressing period. The result is the previous charge of −15 volts of pixels P(12), P(21) and P(32) being retained for display purposes and pixels P(11), P(13) and P(33) will be charged to +15 volts for display purposes while the transistors of the remaining pixels are maintained in the initial normally-off state as illustrated in FIG. 10.

Figure 11:
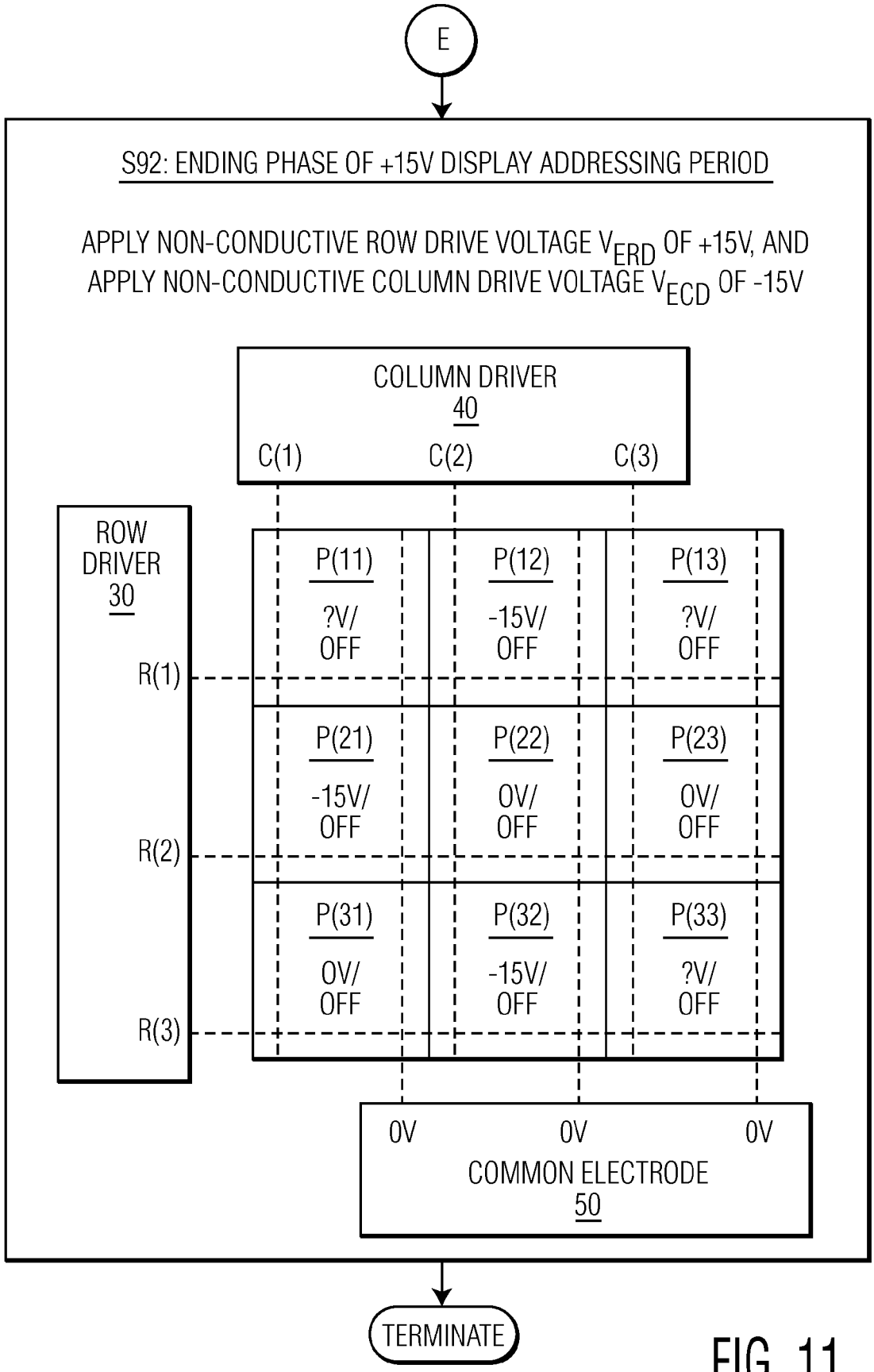

Referring to FIG. 11, a stage S92 of flowchart 80 encompasses applying non-conductive row drive voltages $V_{ERD}$ of +15 volts on rows R(1)-R(3) and applying non-conductive column drive voltages $V_{ECD}$ of −15 volts on columns C(1)-C(3) during an ending phase of the +15V display addressing period. The result is all of the transistor are set to the normally-off state with the previous charge of −15 volts of pixels P(12), P(21) and P(32) being retained for display purposes and the previous charge of +15 volts of pixels P(11), P(13) and P(33) being undefined yet sufficient for display purposes as illustrated in FIG. 11.

A total time for addressing the 3×3 pixel matrix based on a width/length ratio of transistors 60 being 20 is equal to stage S82: (3 rows×1 microsecond)+stage S84: (−15 volt charging time)+stage S86: (1 microsecond)+stage S88: (3 rows×1 microsecond)+stage S90: (+15 volt charging time)+stage S92: (1 microsecond) with the total time for addressing one or more additional rows increasing by 2 microseconds per additional row. This supports the beneficial use of larger panels with small transistors 60 having low field-effect mobility.

Figure 12:
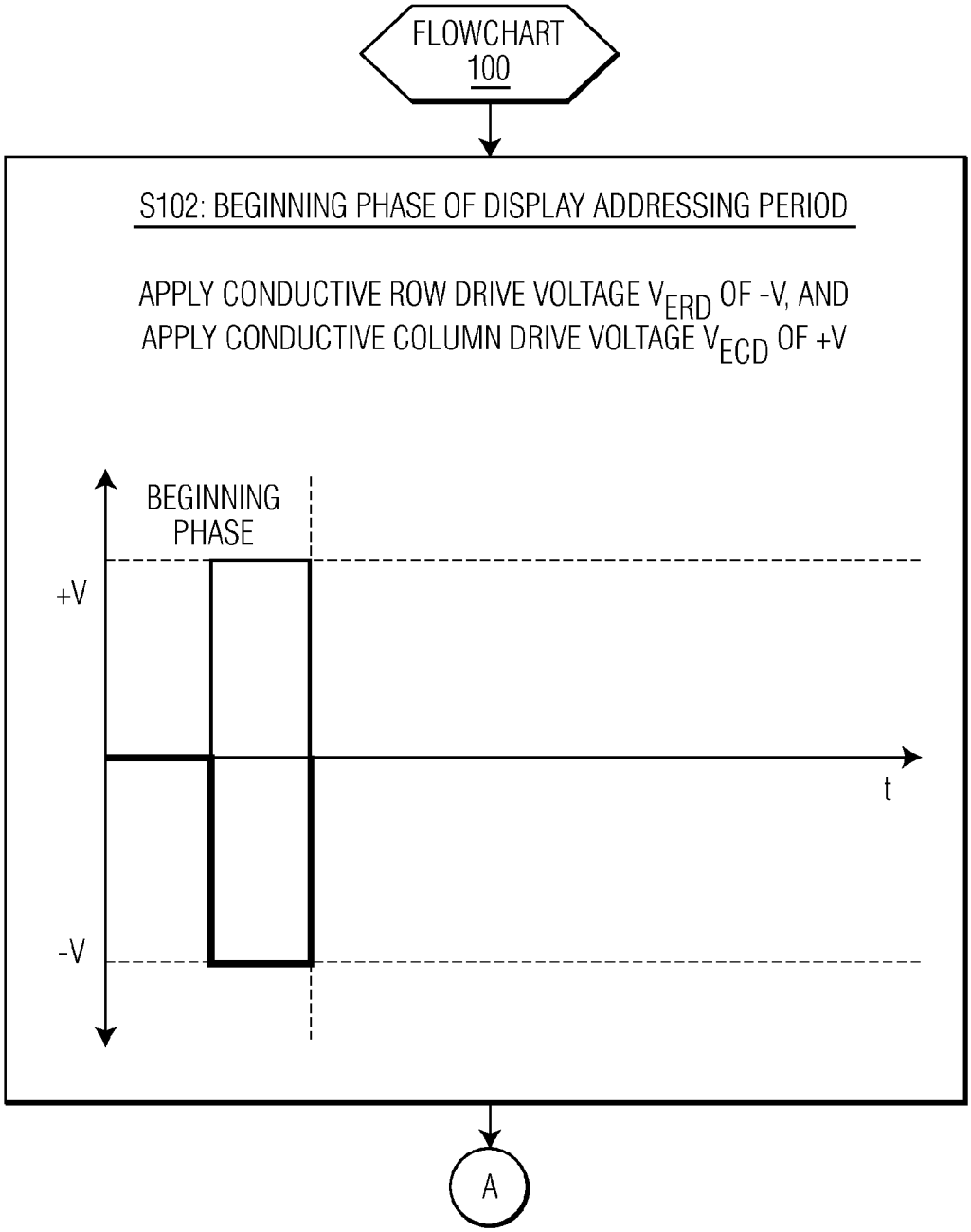
FIGS. 12-14 illustrate a flowchart representative of one embodiment of an active matrix liquid crystal display addressing scheme of the present invention.
Figure 13:
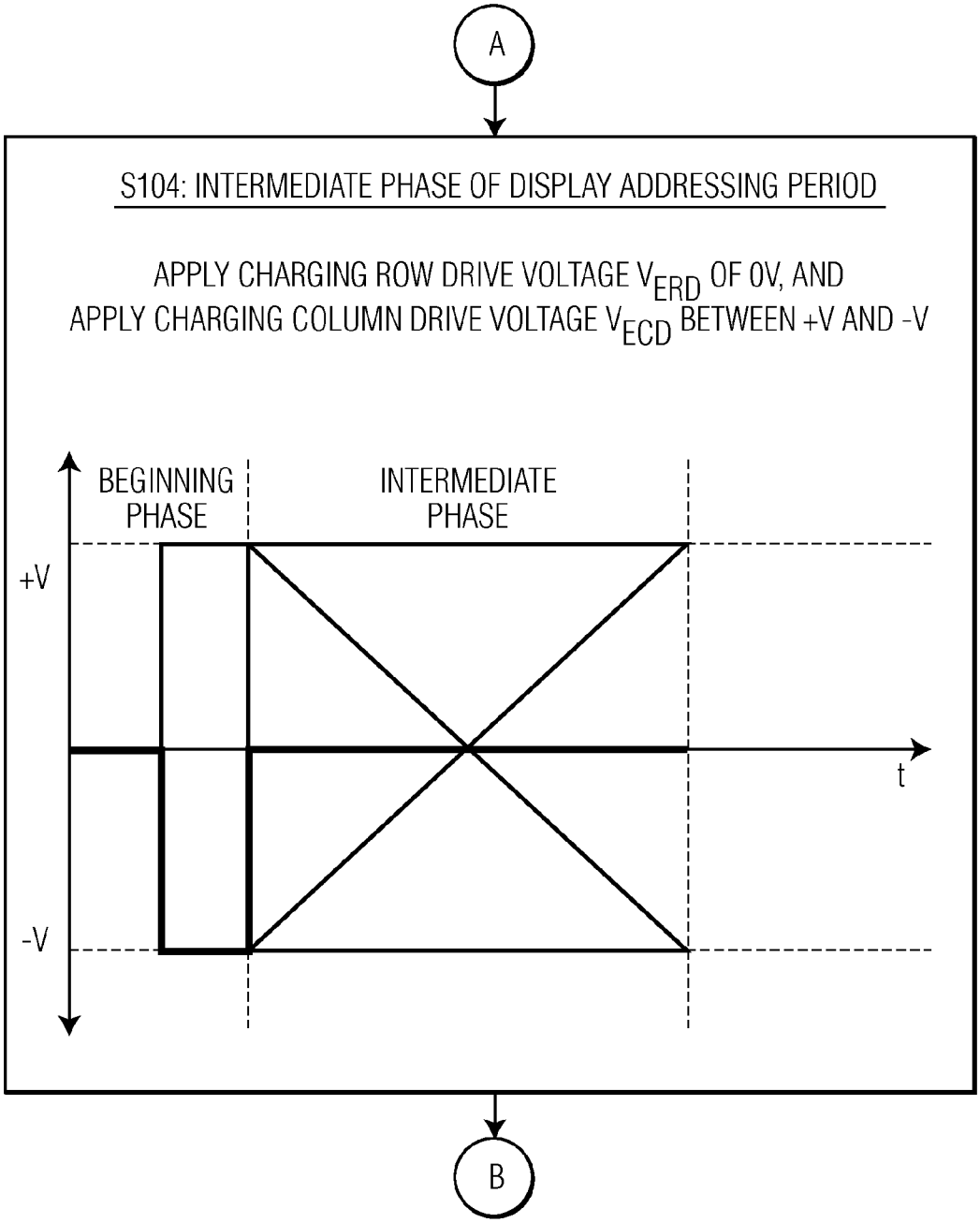
Figure 14:
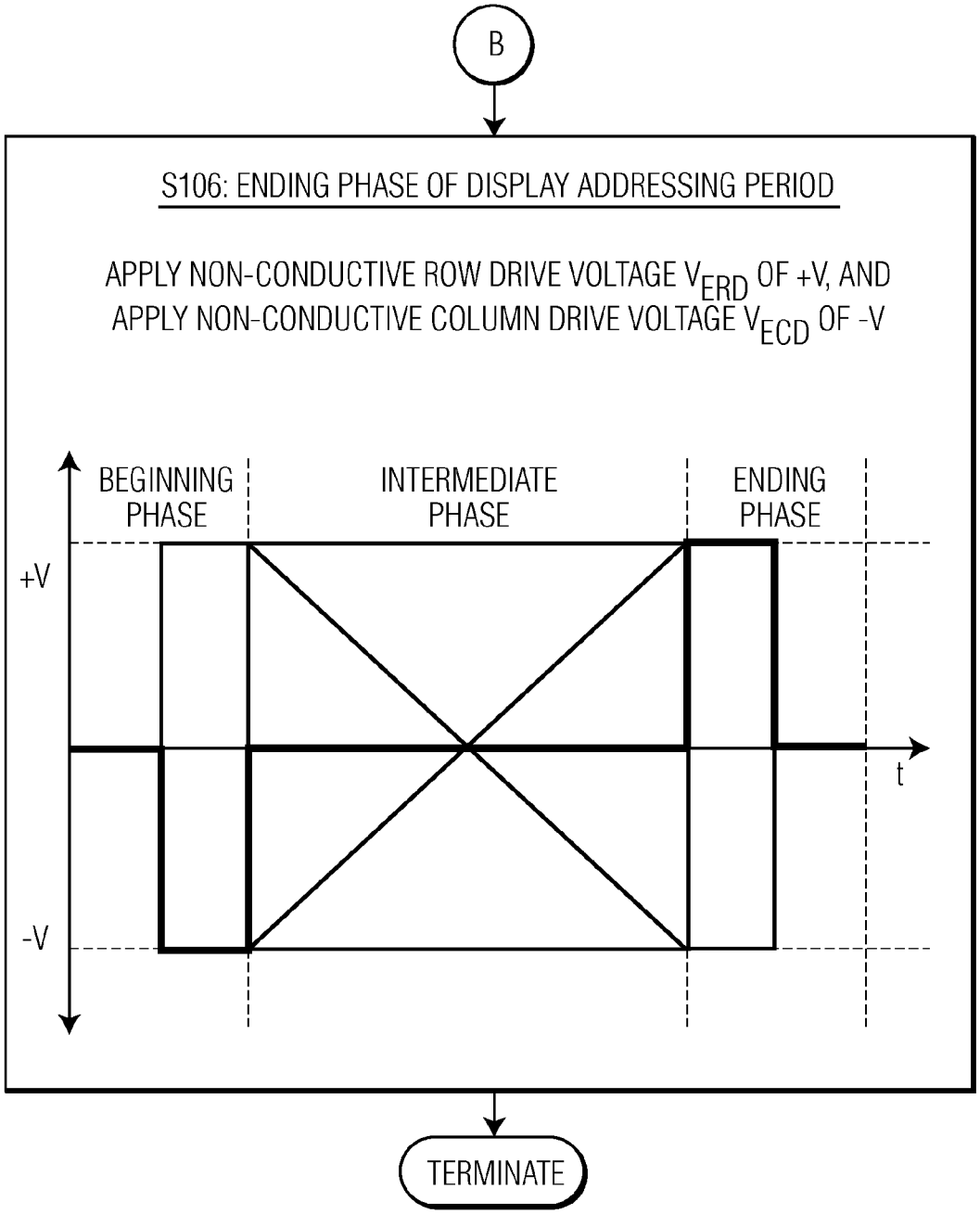

To further facilitate an understanding of the active matrix addressing scheme of the present invention as embodied in FIG. 70 (FIG. 4), the following is a description of an active matrix liquid crystal addressing scheme of the present invention as embodied in a flowchart 100 as illustrated in FIGS. 12-14. As illustrated in FIGS. 12-14, flowchart 100 will be described in the context of a switching threshold of 30V. Further, in practice, a display using the active matrix liquid crystal addressing scheme as represented by flowchart 100 is addressed a row-at-a-time. Flowchart 100 therefore represents a single row scan of the scheme that is repeated for each row as would be appreciated by those having ordinary skill in the art.

Referring to FIG. 12, a stage S102 of flowchart 100 encompasses applying conductive row drive voltage $V_{BRD}$ of −V and applying conductive column drive voltage $V_{BCD}$ of +V to each transistor 60 of a scanned row during a beginning phase of a display addressing period. The result is all transistors 60 of the scanned row will be switched to the normally-on state.

Referring to FIG. 13, a stage S104 of flowchart 100 encompasses applying charging row drive voltages $V_{IRD}$ of 0 volts and applying charging column drive voltages $V_{ICD}$ of between +V and −V to each transistor 60 of a scanned row during an intermediate phase of the display addressing period. The result is each pixel display element 62 of the scanned row will be appropriately charged for display purposes.

Referring to FIG. 14, a stage S106 of flowchart 100 encompasses applying charging row drive voltage $V_{IRD}$ of +V and applying non-conductive column drive voltage $V_{ECD}$ of −V to each transistor 60 of a scanned row during an ending phase of the display addressing period of that row. The result is all transistors 60 of the scanned row will be switched to the normally-off state (i.e., non-conductive state) whereby all previous charges are maintained by each pixel display element 62 of the scanned row.

Referring to FIGS. 2-14, those having ordinary skill in the art will appreciate numerous advantages of the present invention including, but not limited to, providing an addressing scheme that derives various benefits from the use of a ferroelectric thin film transistor as a memory element of a pixel.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A display comprising:

a row driver;

a column driver;

a pixel including;

a memory element in a form of a ferroelectric thin film transistor operably coupled to the row driver and the column driver, and a display element operably coupled to the ferroelectric thin film transistor;

wherein the row driver and the column driver are operable to apply different drive voltages to the ferroelectric thin film transistor during a beginning phase, an intermediate phase and an ending phase of an addressing period for the pixel;

wherein the ferroelectric thin film transistor is operable to be set to a conductive state in response to a conductive row drive voltage and a conductive column drive voltage being applied to the ferroelectric thin film transistor by the row driver and the column driver during the beginning phase of the addressing period for the pixel;

wherein the ferroelectric thin film transistor is further operable to facilitate a charging of the display element in response to a charging row drive voltage and a charging column drive voltage being applied to the ferroelectric thin film transistor by the row driver and the column driver during the intermediate phase of the addressing period for the pixel;

wherein the ferroelectric thin film transistor is further operable to be reset to a non-conductive state in response to a non-conductive row drive voltage and a non-conductive column drive voltage being applied to the ferroelectric thin film transistor by the row driver and the column driver during the ending phase of the addressing period for the pixel; and wherein the charging column drive voltage is between the conductive column drive voltage and the non-conductive column drive voltage.

2. The display of claim 1, wherein the row driver is in electrical communication with a gate electrode of the ferroelectric thin film transistor to facilitate an application of the conductive row drive voltage to the gate electrode of the ferroelectric thin film transistor during the beginning phase of the addressing period of the pixel.

3. The display of claim 1, wherein the row driver is in electrical communication with a gate electrode of the ferroelectric thin film transistor to facilitate an application of the charging row drive voltage to the gate electrode of the ferroelectric thin film transistor during the intermediate phase of the addressing period of the pixels.

4. The display of claim 1, wherein the row driver is in electrical communication with a gate electrodes of the ferroelectric thin film transistor to facilitate an application of the non-conductive row drive voltage to the gate electrode of the ferroelectric thin film transistor during the ending phase of the addressing period of the pixel.

5. The display of claim 1, wherein the column driver is in electrical communication with a source electrode of the ferroelectric thin film transistor to facilitate an application of the conductive column drive voltage to the source electrode of the ferroelectric thin film transistor during the beginning phase of the addressing period of the pixel.

6. The display of claim 1, wherein the column driver is in electrical communication with a source electrode of the ferroelectric thin film transistor to facilitate an application of the charging column drive voltage to the source electrode of the ferroelectric thin film transistor during the intermediate phase of the addressing period of the pixel.

7. The display of claim 1, wherein the column driver is in electrical communication with a source electrode of the ferroelectric thin film transistor to facilitate an application of the non-conductive column drive voltage to the source electrode of the ferroelectric thin film transistor during the ending phase of the addressing period of the pixels.

8. The display of claim 1, wherein the display element is in electrical communication with a drain electrode of the ferroelectric thin film transistor to facilitate a charging of the display element in response to the charging row drive voltage and the charging column drive voltage being applied to the ferroelectric thin film transistor by the row driver and the column driver during the intermediate phase of the addressing period for the pixels.

9. The display of claim 1, wherein the display element is an electrophoretic display element.

10. The display of claim 1, wherein the display element is a liquid crystal display element.

11. A display comprising:

a plurality of pixels, each pixel including:

a memory element in the form of a ferroelectric thin film transistor operably coupled to the column driver and the row driver, and a display element operably coupled to the ferroelectric thin film transistor;

wherein the ferroelectric thin film transistor is operable to be set to a conductive state in response to a conductive row drive voltage and a conductive column drive voltage being applied to the ferroelectric thin film transistor during a beginning phase of the addressing period for the pixel;

wherein the ferroelectric thin film transistor is further operable to facilitate a charging of the display element in response to a charging row drive voltage and a charging column drive voltage being applied to the ferroelectric thin film transistor during an intermediate phase of the addressing period for the pixel; and wherein the ferroelectric thin film transistor is further operable to be reset to a non-conductive state in response to a non-conductive row drive voltage and a non-conductive column drive voltage being applied to the ferroelectric thin film transistor during an ending phase of the addressing period for the pixel; and wherein the charging column drive voltage is between the conductive column drive voltage and the non-conductive column drive voltage.

12. The display of claim 11, wherein the conductive row drive voltage is selectively applied to a gate electrode of the ferroelectric thin film transistor during the beginning phase of the addressing period of the pixel.

13. The display of claim 11, wherein the charging row drive voltage is selectively applied to a gate electrode of the ferroelectric thin film transistor during the intermediate phase of the addressing period of the pixel.

14. The display of claim 11, wherein the non-conductive row drive voltage is selectively applied to a gate electrode of the ferroelectric thin film transistor during the ending phase of the addressing period of the pixel.

15. The display of claim 11, wherein the conductive column drive voltage is selectively applied to a source electrode of the ferroelectric thin film transistor during the beginning phase of the addressing period of the pixel.

16. The display of claim 11, wherein the charging column drive voltage is selectively applied to a source electrode of the ferroelectric thin film transistor during the intermediate phase of the addressing period of the pixel.

17. The display of claim 11, wherein the non-conductive column drive voltage is selectively applied to a source electrode of the ferroelectric thin film transistor during the ending phase of the addressing period of the pixel.

18. The display of claim 11, wherein the display element is in electrical communication with a drain electrode of the ferroelectric thin film transistor to facilitate a charging of the display element in response the charging row drive voltage and the charging column drive voltage being applied to a gate electrode and a source electrode of the ferroelectric thin film transistor during the intermediate phase of the addressing period for the pixel.

19. The display of claim 11, wherein the display element is an electrophoretic display element.

20. The display of claim 11, wherein the display element is a liquid crystal display element.

* * * * *